US007698923B2

(12) United States Patent
Rackel

(10) Patent No.: US 7,698,923 B2
(45) Date of Patent: Apr. 20, 2010

(54) METHOD OF AND DEVICE FOR EXCHANGING SETS OF ROLLS

(75) Inventor: Harald Rackel, Hilchenbach (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 678 days.

(21) Appl. No.: 10/584,431

(22) PCT Filed: Jan. 21, 2005

(86) PCT No.: PCT/EP2005/000593

§ 371 (c)(1),
(2), (4) Date: Jun. 22, 2006

(87) PCT Pub. No.: WO2005/089972

PCT Pub. Date: Sep. 29, 2005

(65) Prior Publication Data

US 2009/0013745 A1 Jan. 15, 2009

(30) Foreign Application Priority Data

Feb. 18, 2004 (DE) ..... 10 2004 007 831

(51) Int. Cl.
*B21B 31/08* (2006.01)

(52) U.S. Cl. ..... 72/239

(58) Field of Classification Search ..... 72/237–239
See application file for complete search history.

(56) References Cited

U.S. PATENT DOCUMENTS 3,611,779 A * 10/1971 Simmonds ..... 72/239
4,771,626 A 9/1988 Ichida et al.
5,009,096 A * 4/1991 Maenpaa et al. ..... 72/239
2005/0000263 A1 1/2005 Wittkopf

FOREIGN PATENT DOCUMENTS

JP 05115908 A * 5/1993

OTHER PUBLICATIONS

Patent Abstract of Japan JP 56154208, Nov. 1981.

* cited by examiner

*Primary Examiner*—Dana Ross
*Assistant Examiner*—Debra M Sullivan
(74) *Attorney, Agent, or Firm*—Abelman, Frayne & Schwab

(57) ABSTRACT

A method of and an installation for exchange of roll sets (5, 6) contemplate provision of a number of separate transversely displaceable carriages (9, 10, 11), whereby individual worn-out working roll sets (6) are displaced along a single connection track (14) by a single locomotive (21) in a roll workshop (20), and a new working roll set (6*a*) is displaced back to an installation position, and wherein during formation of a gap (12) in front of a rolling mill stand (2, 3, 4), a withdrawn backup roll set (5) is transported by a crane in the roll workshop and back.

13 Claims, 11 Drawing Sheets

METHOD OF AND DEVICE FOR EXCHANGING SETS OF ROLLS

BACKGROUND OF THE INVENTION

1. Field of the Invention

The invention relates to a method of and an installation for exchanging roll sets in rolling mill stands of a rolling mill train with several rolling mill stands which include respective backup and working roll sets, by displacing a working roll set or a backup roll set, which are supported on top of each other, in an axial direction, on an operator's side, into a roll workshop and subsequently displacing back and mounting new roll sets.

2. Description of the Prior Art

Such method of exchanging roll sets is disclosed in DE 43 21 663 A1. Firstly, on the operator's side of the rolling mill stands, there are provided support plates that are supported on a carriage, are displaced transverse to the roll axes, and are equipped with at least two rail pairs arranged adjacent to each other. The working roll sets themselves are supported on rolls. In front of the rolling mill stands, there are formed pits on the bottom of which draw-out rails for backup roll sets are provided. The pits are closed with swing covers that likewise carry rails along which the working roll sets are drawn out or inserted. Neither the construction with pits nor the use of rails over the pits are particularly convenient.

U.S. Pat. No. 4,772,626 discloses transportation of backup roll sets and working roll sets together on a carriage. The transfer of different roll sets depends on a tall construction of roll exchange carriages having a large bearing capacity, and the method is very complicated.

The object of the present invention is to provide with small constructional modifications, a flexible method of exchanging roll sets in selected rolling mill stands and which would correspond to the operating cycle in a roll workshop.

SUMMARY OF THE INVENTION

The object of the invention is achieved, according to the invention, in that on the operator's side, individual worn-out working roll sets are brought on a number of separate transversely displaceable carriages that corresponds to a number of the rolling mill stands, one after another along a single connection track by a single locomotive into the roll workshop and, therefrom, new working roll sets are displaced back and are set at exchange distances on respective transversely displaceable carriages between the rolling mill stands, and in that after unblocking of the operator's side by the transversely displaceable carriages, after dismantled respective worn-out working roll sets, the worn-out backup roll sets are withdrawn and are brought with a crane in the roll workshop, are serviced, are transported back, and are again mounted in corresponding rolling mill stands. The method separates exchange of the working roll sets from the exchange of the backup roll sets and, for that reason alone, is more flexible. The method is more economical because of smaller expenses. The process is applicable to separate rolling mill stands and to the exchange of roll sets.

The simplification of the inventive method and its adaptation to the operation in roll workshop, as well as time saving, is achieved in that in a start position, in front of each rolling mill stand, simultaneously, the transversely displaceable carriage is adjusted to the exchange distance, worn-out working roll sets are removed, after transverse displacement, new working roll stands are placed on another carriage half, and the worn-out working roll sets are displaced, respectively, by their transversely displaceable carriages, over slides on the chock in the roll workshop, are dismantled, and new working roll sets are brought again in the start position.

A further simplification is achieved in that in the start position, a respective worn-out set is pulled onto associated carriage half, and a new working roll set, which is delivered form the roll workshop, is pushed onto the other carriage half at a distance from the axis that corresponds to the exchange distance in front of the rolling mill stand.

A timely and localized exchange of the to-be-exchanged roll sets in respective rolling mill stands can be achieved in that the transversely displaceable carriages are displaced in a rolling direction one after another from their defined positions for rolling mill stand dismantling or installation positions. Thereby, corresponding premises for exchange of backup roll sets can be provided.

According to an embodiment of the invention, with respective intermediate plates pivotal in a horizontal plane precisely reproducible distances and exchange positions with respect to adjacent rolling mill stands are established between the transversely displaceable carriages, and established exchange distances are compensated during pivoting or vertical displacement of the intermediate plates and/or closing plates. Thereby, a precise start of installation of working roll sets in a rolling mill stand is facilitated.

According to a further development of the invention, for exchanging backup roll sets, transversely displaceable carriages are displaced away, and in front of respective rolling mill stands, respective gaps are provided, and worn-out backup roll sets are removed with a crane, and new refurbished backup roll sets are installed with the crane. Thereby, the movements of transportation means for the working roll sets and the backup roll sets are adapted to each other.

As soon as the backup roll sets are displaced to their operational position and are locked in respective rolling mill stands, the gaps in front of the rolling mill stands are closed again by pivoting the intermediate plates, and the transversely displaceable carriages are again displaced in the exchange space.

According to a further embodiment, empty transversely displaceable carriages, with the intermediate plates being pivoted away, are displaced in respective parking positions at one and/or another end of the rolling mill train and are parked.

The installation for exchanging roll sets in rolling mill stands of a rolling mill strain with several rolling mill stands proceeds from the state of the art that provides for connection of respective backup and working roll sets with a drive for transverse dismantling or transverse installation of roll sets, wherein parallel to a rolling direction, rails for transversely displaceable carriages in a foundation and a connection track toward a roll workshop are provided, and the transporting carriages are connected with a drive.

The object of the invention is achieved according to the invention in that the transversely displaceable carriages are displaceable along continuous rails placed in the foundation parallel to the rolling direction at fixed spacings between the rolling mill stands which are controlled with pivotal intermediate plates, and that only one connection track runs, transverse to the rails, in the roll workshop and on which only one locomotive, to which a respective working roll set is attachable or detachable, runs.

The space saving in front of the rolling mill stand is achieved in that the intermediate plates are, respectively, height-adjustable or pivoted away in a vertical plane or are adjustable in a horizontal plane.

Despite the artificial free space in front of the rolling mill stands, advantageously, the transversely displaceable carriages, the intermediate plates pivotal in the horizontal plane, and closing plates, which are provided at the ends of a foundation pit, are fixed against rotation but are pivotal in the horizontal plane and are vertically adjustable, form a continuous accessible working surface. The constructional units can also be operated automatically, so that use of the crane is avoided or it need be used only rarely.

A further automatic step is achieved in that at the ends of the rails that run parallel to the rolling direction, respective fixedly and pivotally supported closing plates are arranged and which provide for movement of the transversely displaceable carriages together with the pivotal intermediate plates, by at least half of the transversely displaceable carriage.

The drawings show an embodiment of the invention that will be described in detail below.

DETAILED DESCRIPTION OF THE PREFERRED EMBODIMENTS

Figure 1A:
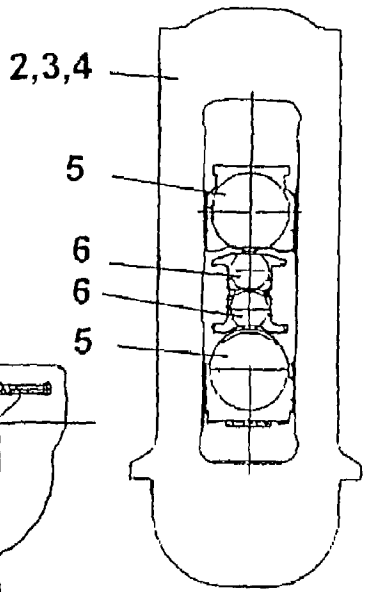
FIG. 1A a roll housing with a working roll set and a backup roll set in an operational position.
Figure 1:
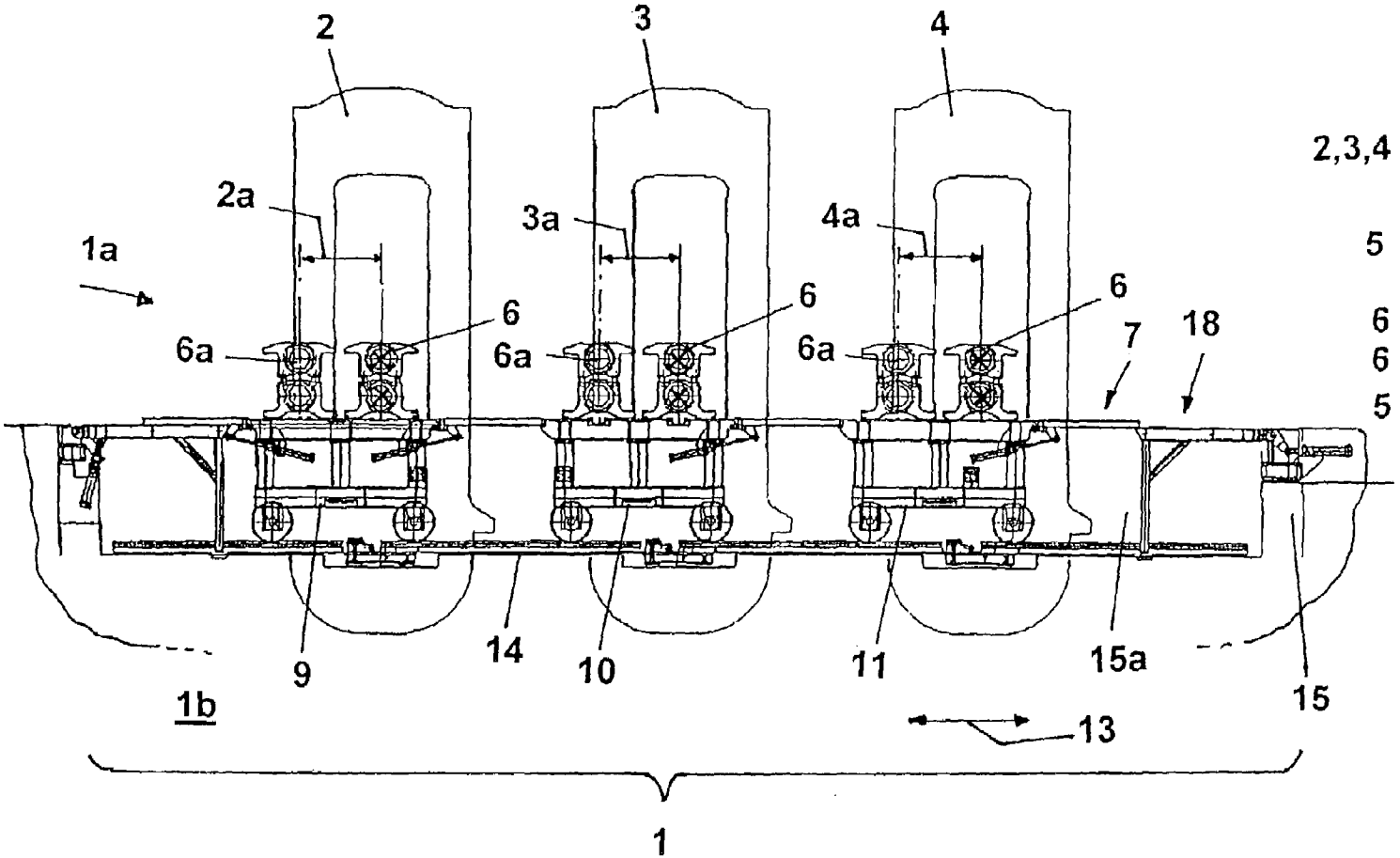
FIG. 1 a side view of a rolling mill train with three rolling mill stands.

In FIGS. 1 and 1A, the rolling mill train 1 is formed, e.g., of three rolling mill stands 2, 3, and 4. Each rolling mill stand 2, 3, 4 has a backup roll set 5 located in an operational position, and worn-out working roll sets 6 with chocks. In FIG. 1, the working roll and backup roll sets 6, 5 are already dismantled and are located, respectively, on first transversely displaceable carriage 9, second transversely displaceable carriage 10, and third transversely displaceable carriage 11. The working roll sets 6 (or 6*a*) consist, respectively, of upper and lower rolls which support each other by means of chocks, just as backup rolls 5 (not shown in detail in the dismantled phase). FIG. 1 shows a start position 1*a* in which the roll exchange is carried out on an operator's side 1*b*. A worn-out working roll set 6 is shown in side view (FIG. 1) and in plan view in FIGS. 2-8 and is shown in the drawings with hatching, and a new working roll set 6*a* is shown without hatching.

On the operator's side 1*b*, there are located a number of separate transversely displaceable carriages 9, 10, 11 which correspond to the number of the rolling mill stands 2, 3, 4 and which carry new working roll sets 6*a* delivered from a roll workshop 20. The worn-out working roll sets 6 are withdrawn with a working roll-draw-out cylinder 8 and a locomotive 21. The separate transversely displaceable carriages 9, 10, 11, which are equipped with their own drives, respectively, are displaceable over a single connection track 14*a* toward the roll workshop 20, and the transversely displaceable carriages 9, 10, 11 are displaceable in a rolling direction 13 on rails 14. Further transportation from the rails 14 onto the connection track 14*a* takes place over slides on respective chocks. The displacement along the connection rail 14*a* is effected with a single locomotive 21. The transversely displaceable carriages 9, 10, 11 are controlled by spacer means 7. After operator's side 1*b* becomes free upon displacement of the transversely displaceable carriages 9, 10, 11 after dismantling of respective worn-out working roll sets 6, the worn-out backup roll sets 5 are dismantled and are brought in the roll workshop 20 by a crane, and new ground rolls are brought back in associated rolling mill stands 2, 3, 4, are mounted there, and are locked. The displacement of the transversely displaceable carriages 9, 10, 11 over the rails 14 in the foundation pit 15*a* of the foundation 15 provides for respective gaps 12 (see also FIG. 9A) for dismantling or mounting of the backup roll sets 5.

The transversely displaceable carriages 9, 10 11 are arranged with a right half for worn-out working roll sets 6 at respective exchange distances 2*a*, 3*a*, 4*a* (with three rolling mill stands) and with left half for new working roll sets 6*a*. The spacer means 7 consists, in the embodiment shown, of pivotal intermediate plates 7*a*. The intermediate plates 7*a* are relatively light and thin, so that a crane for their manipulation is not necessary.

Figure 2:
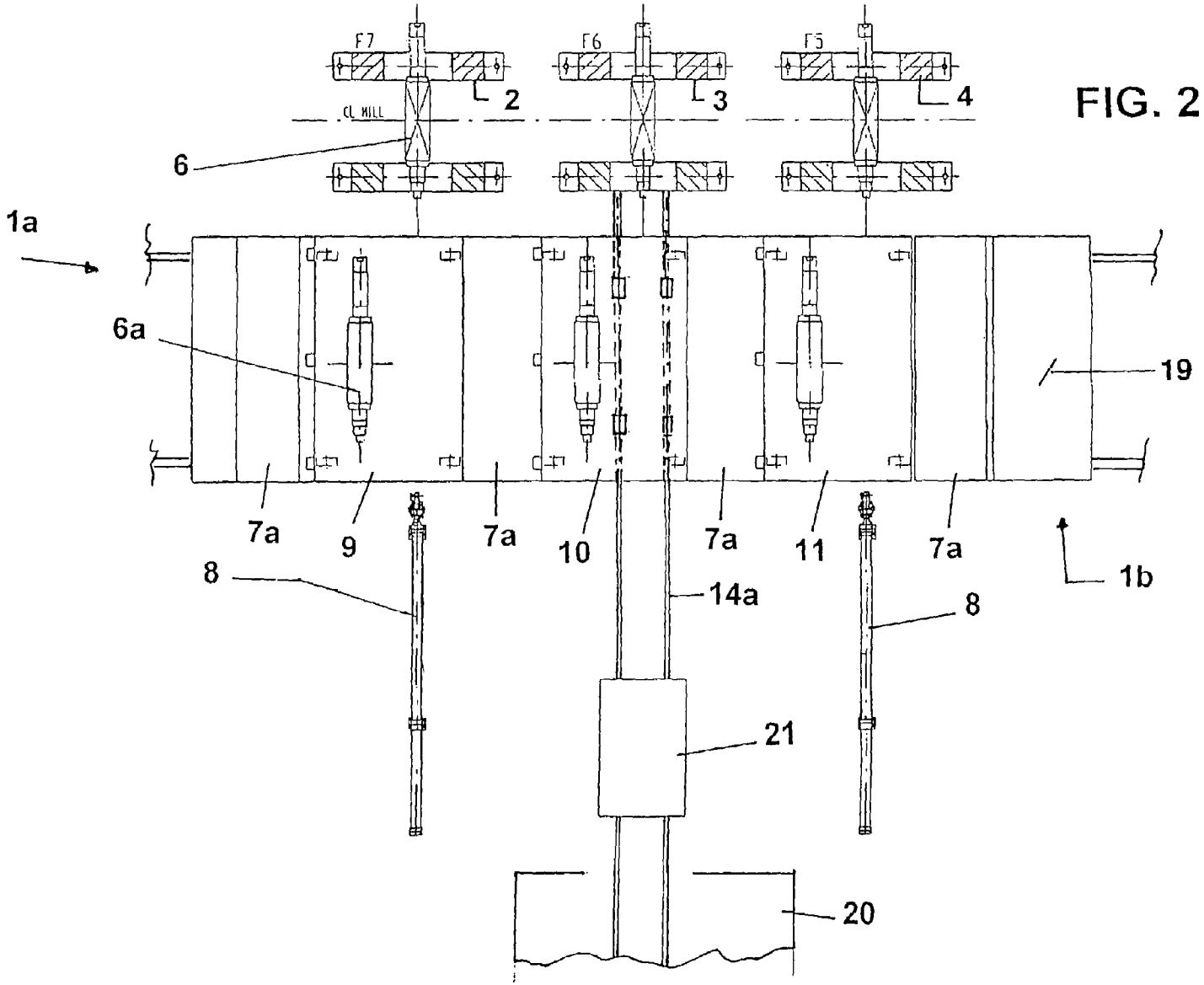
FIGS. 2-9 a plan view of different phases of exchange of the working roll set.
Figure 3:
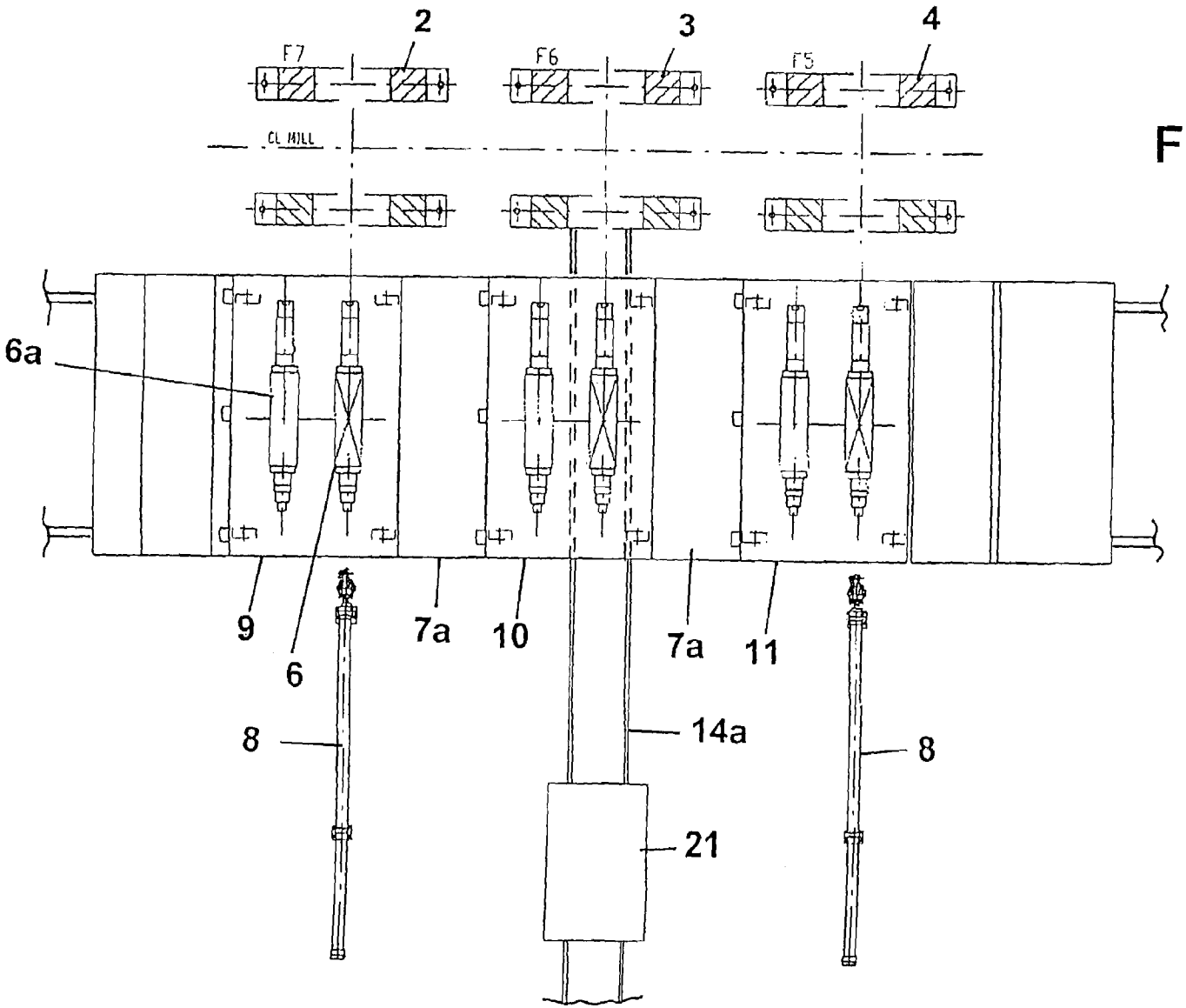

The working roll sets 6*a* are just delivered, as shown in FIGS. 2 and 3, from the remotely located roll workshop 20. The working roll sets 6*a* are attached to the locomotive 21 and are transferred onto the transversely displaceable carriages 9, 10, 11.

FIG. 2 shows a start position 1*a* in front of each rolling mill stand 2, 3, 4, with the transversely displaceable carriages 9, 10, 11 being adjusted with the intermediate plates 7*a* pivotal in a horizontal plane. The worn-out working roll sets 6 are then moved away (FIG. 3). After the transverse displacement onto the other carriage halves, the new working roll sets 6*a* are mounted in respective rolling mill stands 2, 3, 4. The worn-out working roll sets 6 are then displaced into the roll workshop 20 for maintenance. A new working roll set 6*a* is again brought to a start position (FIG. 2), and the cycle begins anew.

A particular feature here is that in the start position 1*a*, respective worn-out working roll sets 6 are pulled onto associated carriage halves, and new working roll sets 6*a* are located at the exchange distance 2*a*, 3*a*, 4*a* in front of the respective rolling mill stands 2, 3, 4, placed on the other carriage halves, whereby a precise adjustment is carried out.

According to FIG. 3, respective transversely displaceable carriages 9, 10, 11 are aligned with distances 2*a*, 3*a*, 4*a* with respect to each other with the intermediate plates 7*a* having been pivoted out. The transversely displaceable carriages 9, 10, 11 are displaced out of these predetermined mounting or dismantled positions in the rolling direction 13 one after another.

Figure 4:
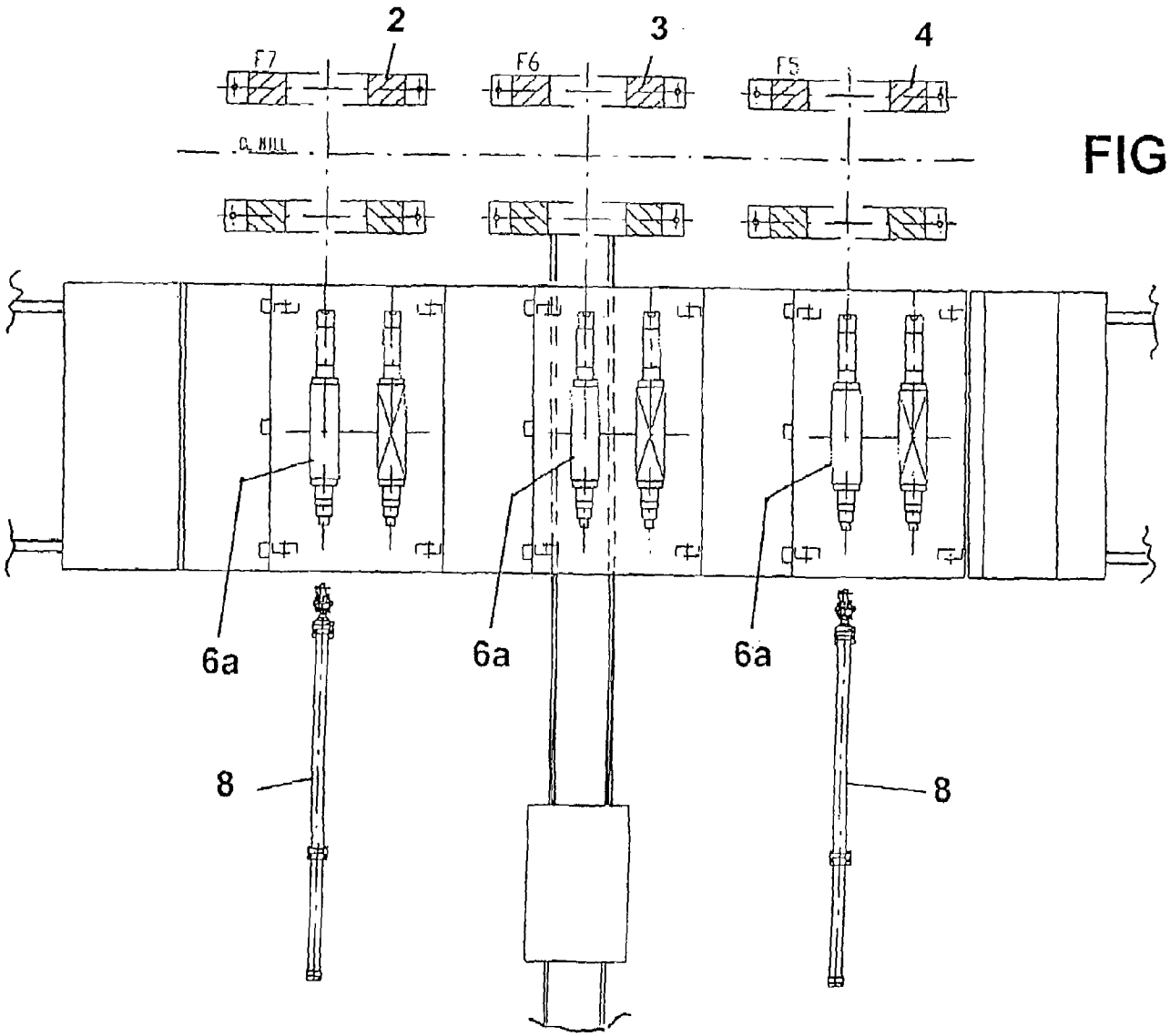

According to FIG. 4, all of the new working roll sets 6*a* are located in their mounting position with respect to the rolling mill stands 2, 3, 4 and are pushed in with the working roll push-in cylinder 8 and the locomotive 21 and are secured in the stands.

Figure 5:
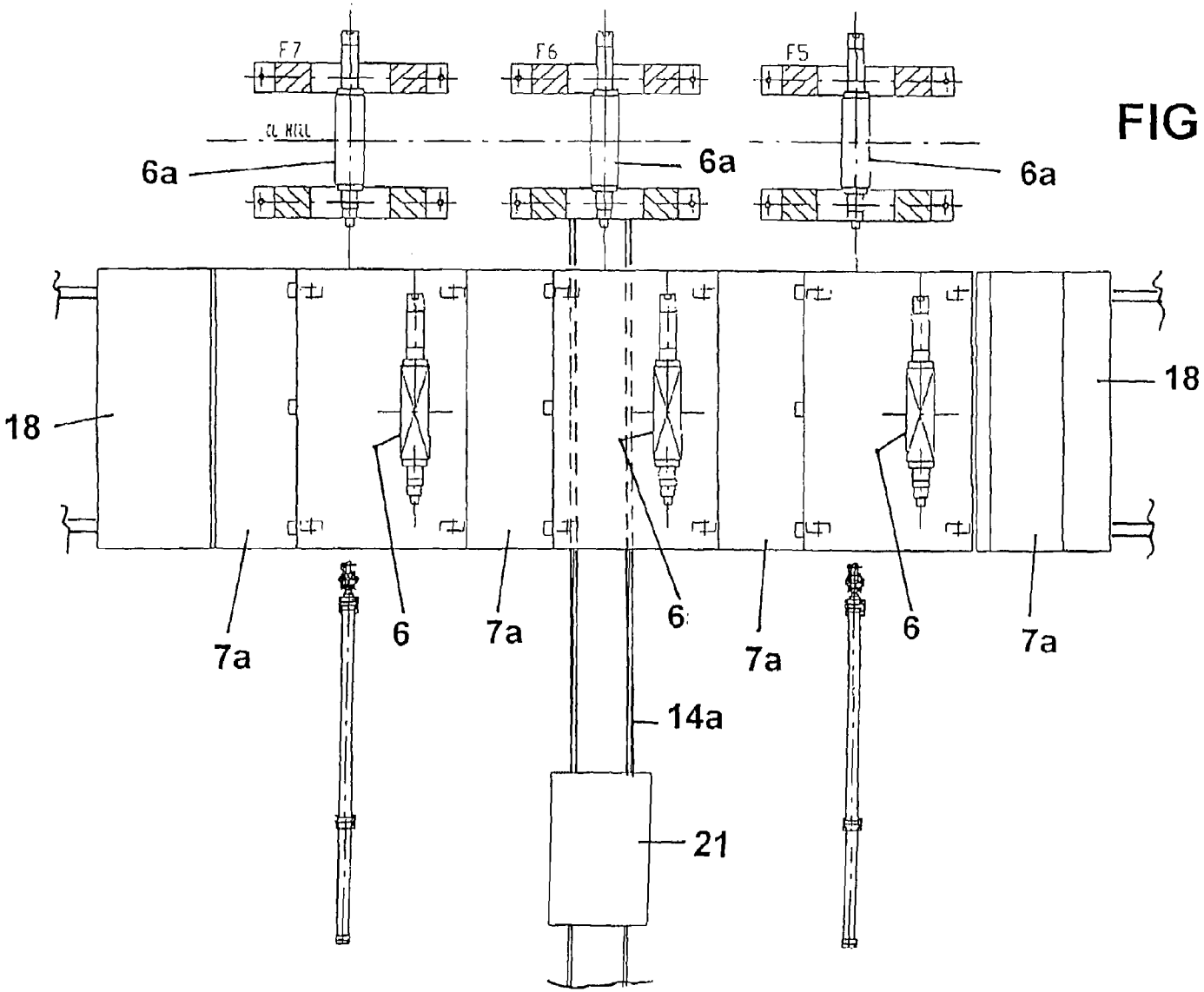
Figure 6:
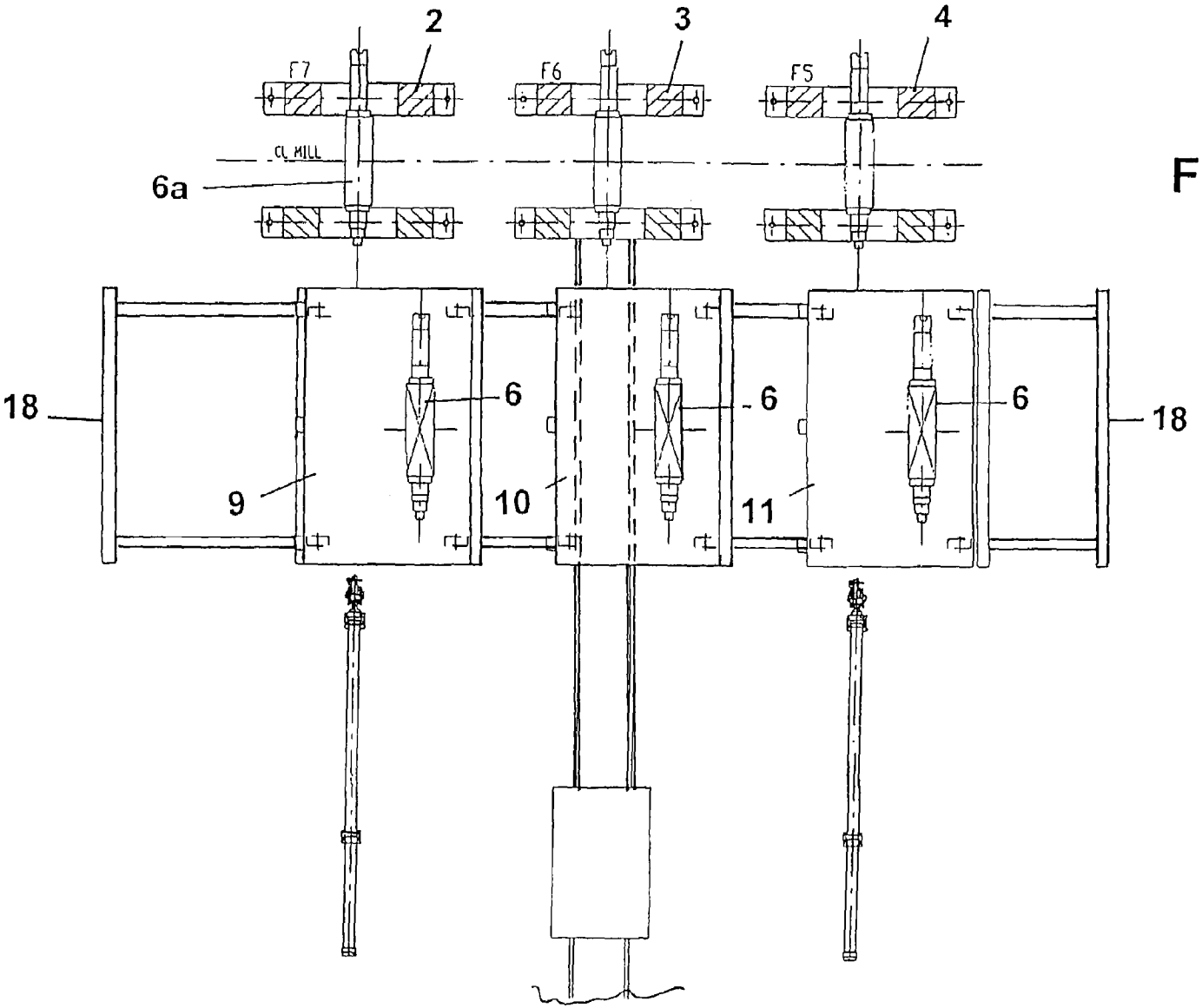

In FIG. 5, the new working roll sets 6*a* are pushed in the working roll stands 2, 3, 4 and are secured in the operational position. With separate movements, the transversely displaceable carriages 9, 10, 11 are repeatedly precisely adjusted, respectively, by the intermediate plates 7*a* pivotal in the horizontal plane, relative to each other at the distances and in the exchange positions relative to the adjacent rolling mill stands 2, 3, 4, with the stationary arranged closing plates 18 at the ends of rails 14 closing the remaining gaps. The distances between the transversely displaceable carriages 9, 10, 11 can be adjusted, respectively, by pivotal movements or transverse movements of the intermediate plates 7*a* and/or the closing plates 18, as shown in FIG. 6.

Figure 9:
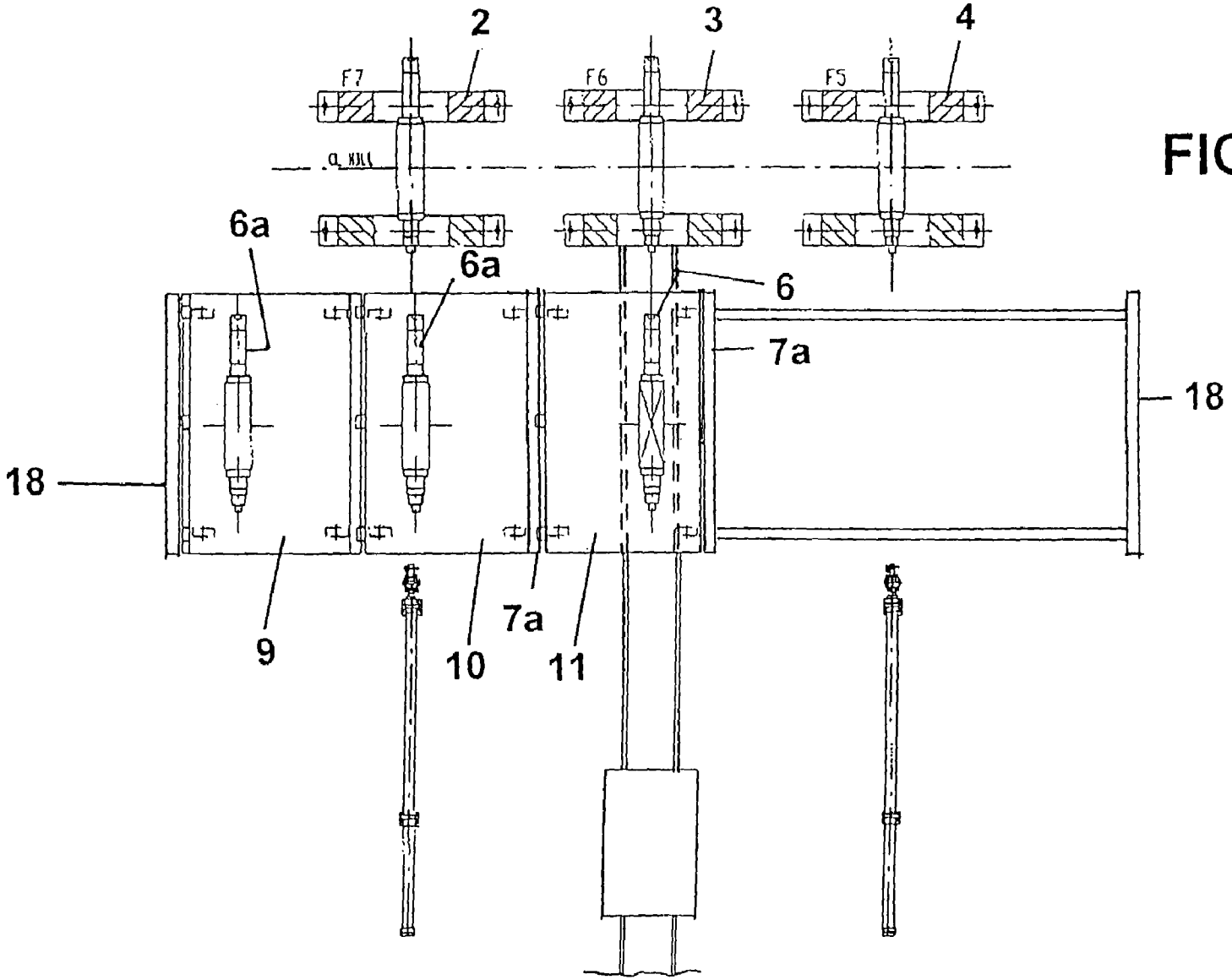
Figure 9A:
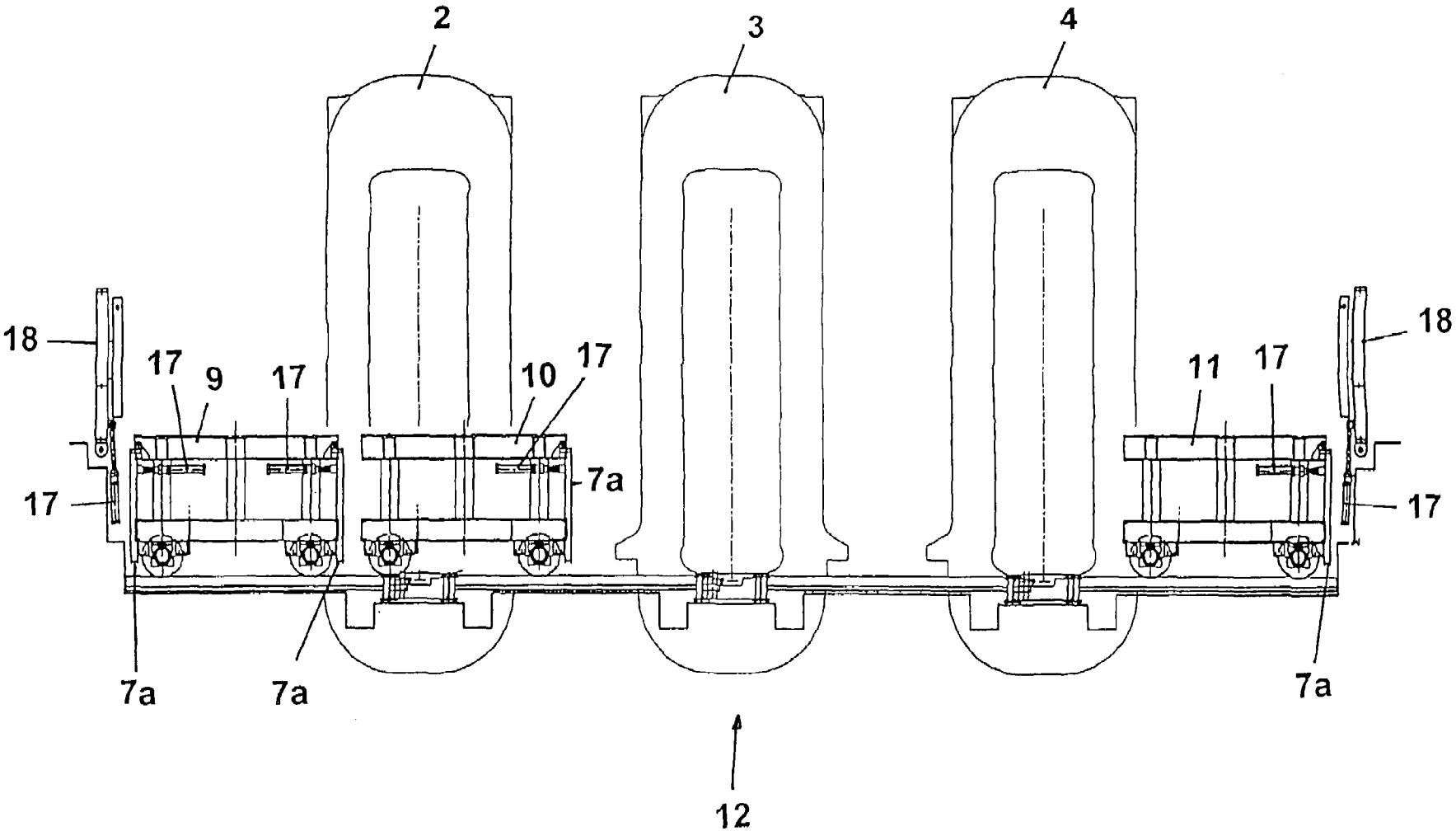
FIG. 9A parking positions of transversely displaceable carriages.

The transverse arrangement of the intermediate plates 7*a* and of the closing plate 18 provides free space so that for the exchange of the backup roll sets 5, in front of respective rolling mill stands 2, 3, 4, respective gaps 12 are formed by moving the transversely displaceable carriages 9, 10, 11 away (see also FIG. 9A). A worn-out backup roll set 5 can be removed by a crane, and a new refurbished backup roll set 5 can be again installed with the crane.

Figure 7:
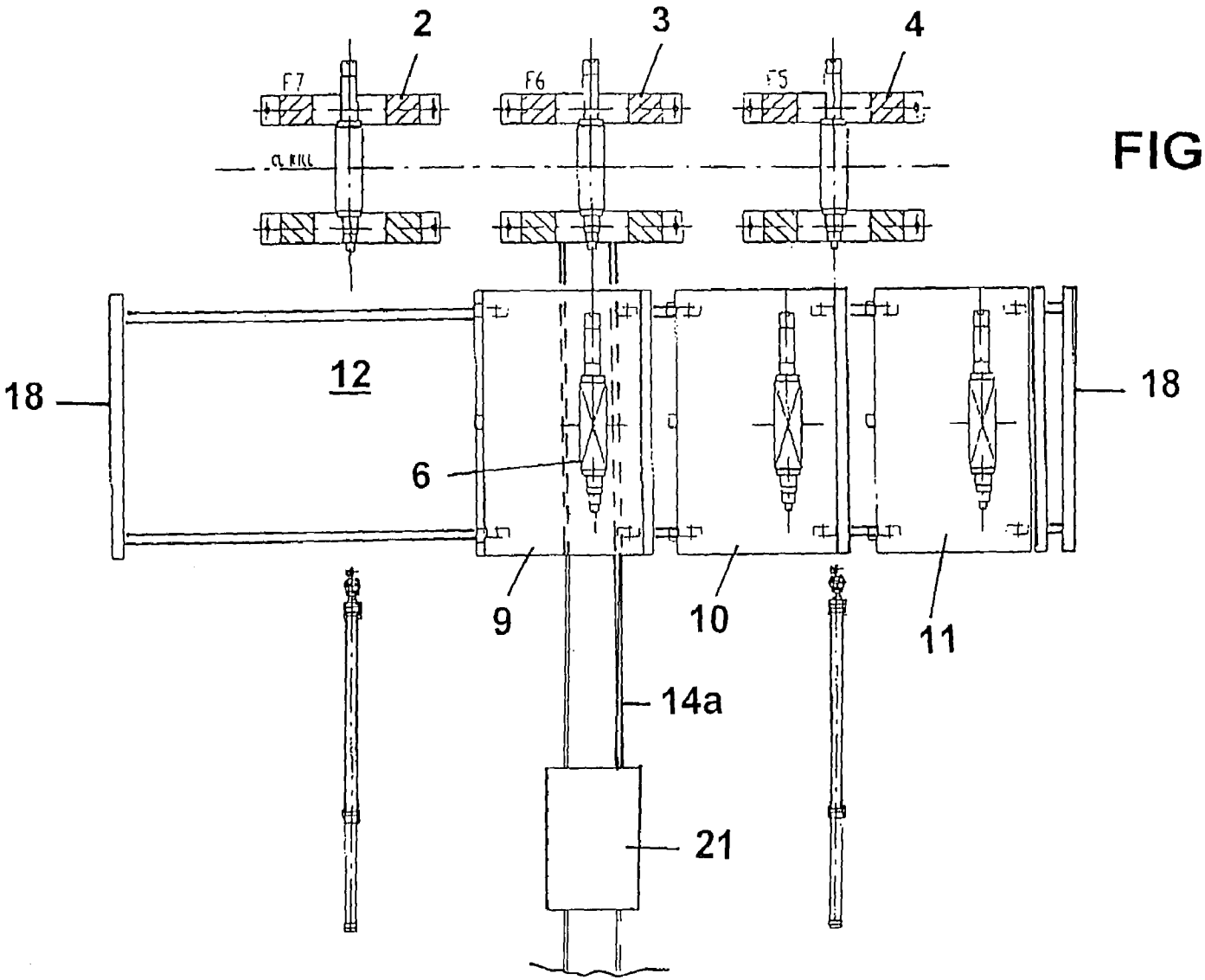

According to FIG. 7, the transversely displaceable carriages 9, 10, 11 are connected one after another to the locomotive 21 displaceable along the connection track 14*a*. Respective worn-out working roll sets 6 are displaced in the roll workshop 20 and are exchanged there for new working roll sets 6*a*.

Figure 8:
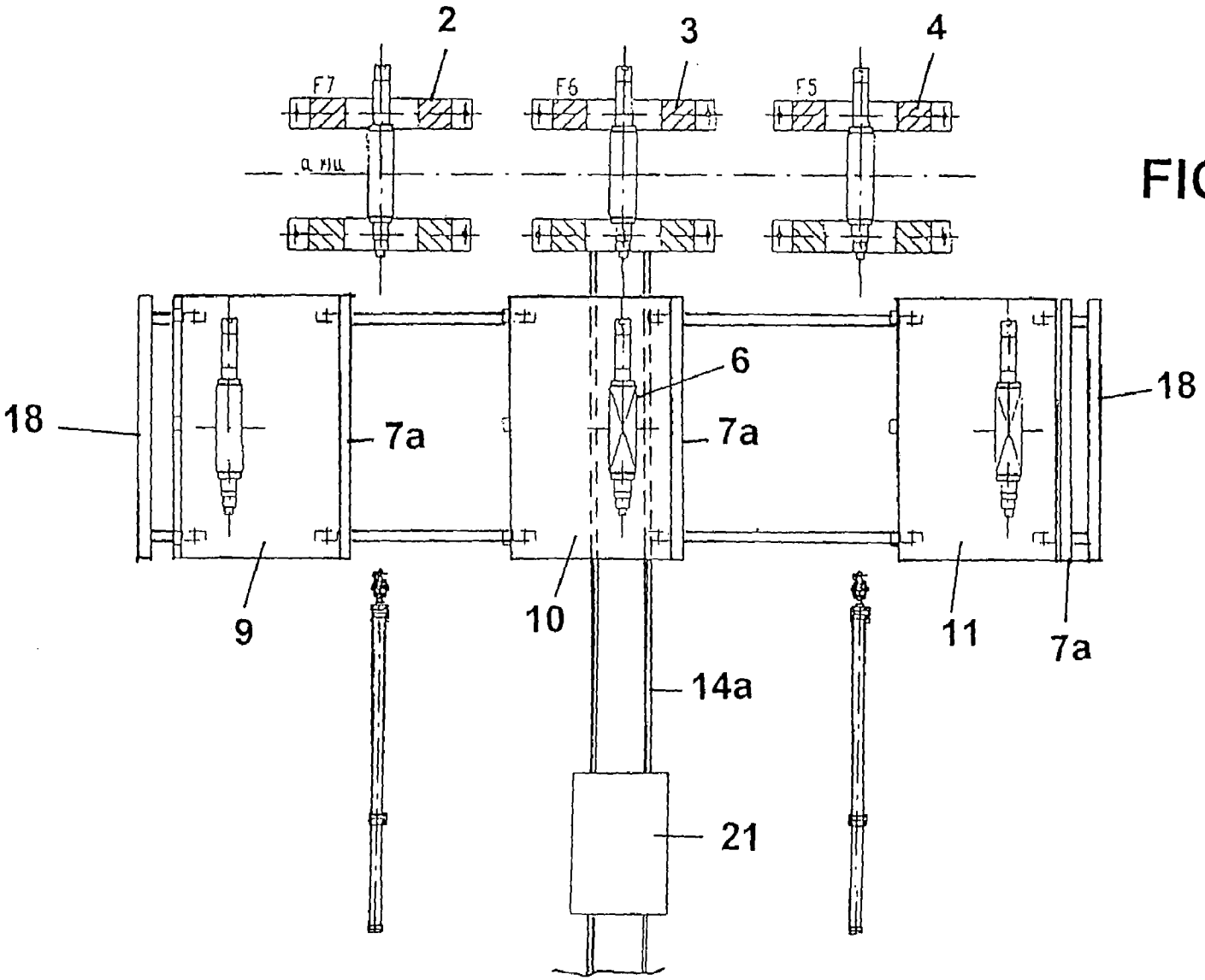

As shown in FIG. 8, respective worn-out working roll sets 6 are displaced into the roll workshop 20 with the locomotive 21, are exchanged there for respective new working roll sets 6*a*, and are displaced back, as also shown in FIG. 8.

According to FIG. 9, the second working roll set 6 is already displaced back from the roll workshop 20, together with a new working roll set 6*a*. Only the third worn-out working roll set 6 has to be displaced in the roll workshop 20.

FIG. 9A shows that empty transversely displaceable carriages 9, 10, 11 are displaced, at the pivoted-out or transversely lifted intermediate plates 7*a* and closing plates 18, in a left parking position (transversely displaceable carriages 9, 10) and in a right parking position (transversely displaceable carriage 11), with the intermediate plates 7*a* being pivoted out and the closing plates 18 being lifted in order to save space. Thereby, the gaps 12 in front of rolling mill stands 3 and 4 remain free for other manipulations.

As further shown in FIG. 9A, the intermediate plates 7*a* are pivotally supported on respective transversely displaceable carriages 9, 10, 11 and are displaced toward and away with displaceable on the carriage, pneumatic or hydraulic piston-cylinder drives 17. The piston-cylinder drives 17 are provided on the closing plates 18, doubly on the first transversely displaceable carriage 9, and on one side, on the right, on the second and third transversely displaceable carriages 10 and 11.

Figure 10:
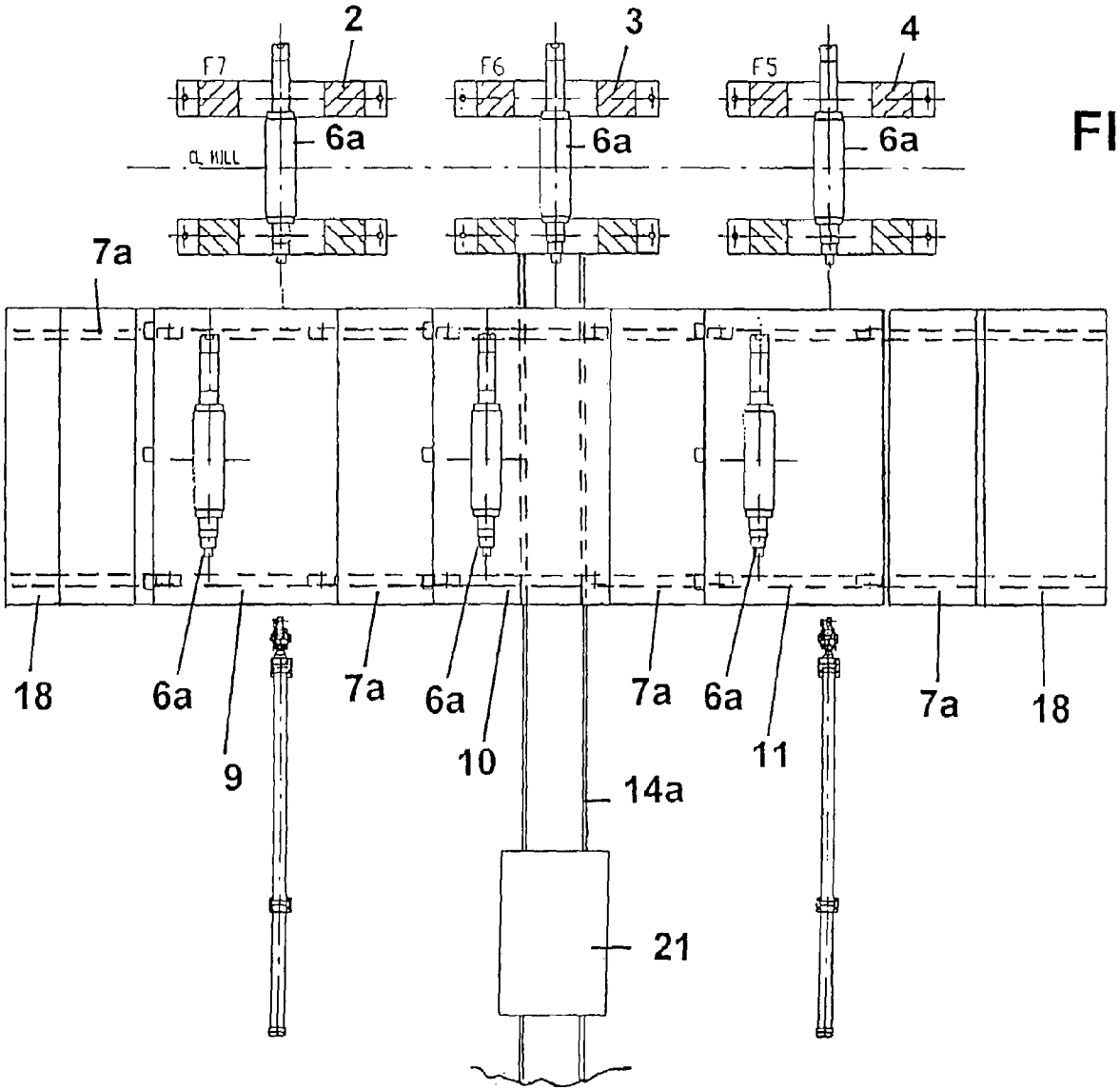
FIG. 10 a plan view of the phase "pivoting of intermediate plates" with return to a start position according to FIG. 2.

After being loaded with a new working roll set 6*a*, the transversely displaceable carriages 9, 10, 11 are displaced, as shown in FIG. 10, again in the mounting position in front of the rolling mills stands 2, 3, 4. Finally, the intermediate plates 7*a* are displaced into a horizontal plane, and the closing plates 18 are lowered in the horizontal plane. The new working roll sets 6*a* are located in a position for a rapid replacement of worn-out working rolls sets 6. The invention also provides for exchange of separate worn-out working roll sets 6.

The transversely displaceable carriages 9, 10, 11, together with the pivotal in the horizontal plane, intermediate plates 7*a* and arranged at the ends of a foundation pit 15*a*, liftable and horizontally pivotal, stationary closing plates 18, form, in the horizontal plane, a continuous accessible working surface 19.

In FIGS. 1, 2-5 and 10, at the ends of the rails 14, there are arranged, parallel to the rolling, direction 13, stationary, pivotally and vertically adjustable, closing plates 18 that form, together with the intermediate plates 7*a*, the working surface 19.

LIST OF REFERENCE NUMERALS

1. Rolling mill train
1*a*. Start position
1*b*. Operator's side
2. Roll stand
2*a*. Exchange distance
3. Roll stand
3*a*. Exchange distance
4. Roll stand
4*a*. Exchange distance
5. Set of backup rolls
6. Worn-out work roll set (Drawings; with hatching)
6*a*. New work roll set (Drawings: without hatching)
7. Spacer means
7*a*. Pivotal intermediate plate
8. Work roll-draw-out cylinder
9. First transversely displaceable carriage
10. Second transversely displaceable carriage
11. Third transversely displaceable carriage
12. Gap in front of a roll stand
13. Rolling direction
14. Rails
14*a*. Connection track
15. Foundation
15*a*. Foundation pit
16. Spacings
17. Piston-Cylinder drive
18. Stationary secured closing plate
19. Accessible Working surface
20. Roll workshop
21. Locomotive

The invention claimed is:

1. An installation for exchanging roll sets (5, 6) in rolling mill stands (2, 3, 4) of a rolling mill train (1) with several rolling mill stands (2, 3, 4) having respective backup and working roll sets (5, 6), comprising a drive for transverse mounting and dismounting roll sets (5, 6); transversely displaceable carriages (9, 10, 11) connected with the drive; continuous rails (14) for the transversely displaceable carriages (9, 10, 11) and which are placed in a foundation (15) parallel to a rolling direction (13) at fixed distances (16) between the rolling mill stands (2, 3, 4); pivotal intermediate plates (7*a*) for controlling the distances (16); a single connection track (14*a*) extending to a roll workshop (20) transverse to the rails (14) for the transversely displaceable carriages (9, 10, 11); and a locomotive (21) displaceable along the connection track (14*a*) and to which the working roll sets (6, 6*a*) are attachable and detachable.

2. An installation according to claim 1, wherein the intermediate plates (7*a*) are pivotable upwardly or downwardly in a vertical plane, or are adjustable in a horizontal plane.

3. An installation according to claim 1, wherein the intermediate plates (7*a*) are, respectively, pivotally mounted on respective transversely displaceable carriages (9, 10, 11) and are pivotable by piston cylinder drives (17) pivotally secured on the respective transversely displaceable carriages, (9, 10, 11).

4. An installation according to claim 1, further comprising closing plates (18) provided at ends of a foundation pit (15*a*), and wherein the transversely displaceable carriages (9, 10, 11), intermediate plates (7*a*) pivotal in a horizontal plane, and closing plates (18) pivotally mounted in a stationary position and pivotable vertically and horizontally, form together a continuous accessible surface (19).

5. An installation according to claim 1, wherein at the ends of the rails (14) that run parallel to the rolling direction (13), respective fixedly and pivotally supported closing plates (18) are arranged and which provide for movement of at least half of the transversely displaceable carriages (9, 10, 11) together with the pivotal intermediate plates (7*a*).

6. A method of exchanging roll sets (5, 6) in rolling mill stands (2, 3, 4) of a rolling mill train (1) having a plurality of rolling mill stands each having a working roll set (6) and a backup roll set (5) supported on top of each other, the method comprising the steps of: on an operator's side (1*b*), bringing, in succession, worn-out working roll sets (6) of individual rolling mill stands (2, 3, 4) by separate transversely displaceable carriages (9, 10, 11) a number of which corresponds to a number of rolling mill stands (2, 3, 4) in the rolling mill train (1) and which are displaceable between respective rolling mill stands (2, 3, 4) and a single connection track (14*a*) leading to a roll workshop (20), onto the connection track (14*a*) and advancing the worn-out working roll sets (6) by a single locomotive into the roll workshop (20);

bringing new working roll sets (6*a*) from the workshop (20) and depositing the new working roll sets (6*a*) at predetermined exchanged distances (2*a*, 3*a*, 4*a*) on respective transversely displaceable carriages (9, 10, 11) between the rolling mill stands (2, 3, 4) and distributing the new working roll sets (6*a*) between respective rolling mill stands (2, 3, 4); and after unbiocking the operator's side (1*b*) as a result of displacing of the transversely displaceable carriages (9, 10, 11) away in front of the respective rolling mill stands (2, 3, 4), bringing the worn-out backup roll sets (5) by a crane in the roll workshop (20), servicing the worn-out backup roll sets (5) in the workshop (20), and transporting the serviced backup roll sets (5) from the workshop (20) and mounting the serviced backup roll sets (5) in corresponding rolling mill stands (2, 3, 4).

7. A method according to claim 6, wherein the step of bringing, in succession, worn-out working roll sets (6) includes simultaneously adjusting, in a starting position (1*a*) in front of each rolling mill stand (2, 3, 4), the transversely displaceable carriages (9, 10, 11) to respective exchange distances (2*a*, 3*a*, 4*a*), moving out the worn-out working roll sets (6) on one half of each of the respective transversely displaceable carriages (9, 10, 11) and subsequently moving the worn-out working roll sets (6) by the respective transversely displaceable carriages (9, 10, 11) and via slide strips at respective chocks into the roll workshop (20) and unloading the worn-out working roll sets (6) there, and wherein the step of bringing new working roll sets (6*a*) and distributing the new working roll sets between respective rolling mill stands (2, 3, 4) includes bringing the new working roll sets (6*a*) to the starting position (1*a*) and after the worn-out working roll sets (6) are moved out, transversely displacing the new working roll sets (6*a*) on another half of each of the respective transversely displaceable carriages (9, 10, 11) and moving the new working roll sets (6*a*) by the respective carriages (9, 10, 11) in the respective rolling mill stands (2, 3, 4).

8. A method according to claim 7, wherein the moving-out step includes pulling, in the start position (1*a*), respective worn-out working roll sets (6) onto respective one half of each of the respective transversely displaceable carriages, and wherein the moving-in step includes pushing the new working roll sets (6*a*), which are brought from the roll workshop (20), on the another half of each of the respective carriages (2, 3, 4) at the respective exchange distances (2*a*, 3*a*, 4*a*) and, with respective axial spacings.

9. A method according to claim 6, comprising a step of moving the transversely displaceable carriages (9, 10, 11) in a rolling direction (13) one after another from predetermined positions thereof for mounting the new working roll sets (6*a*) in the respective rolling mill stands (2, 3, 4) and for dismounting the worn-out rolling mill sets (6).

10. A method according to claim 6, comprising a step of providing intermediate plates (7*a*) for establishing, between the transversely displaceable carriages (9, 10, 11), precisely reproducible distances and exchange positions with respect to adjacent rolling mill stands (2, 3, 4), and providing closing plates (18) at ends of a foundation pit (15*a*) with respective intermediate plates (7*a*) being pivotally attached to the transversely displaceable carriages (9, 10, 11) and pivotable in a horizontal plane, and canceling the established exchange distances (2*a*, 3*a*, 4*a*) by pivotal and vertical displacement of at least one of the intermediate plates (7*a*) and the closing plates (18).

11. A method according to claim 10, comprising a step of forming a respective gap in front of each of the rolling mill stands (2, 3, 4) for exchange of the backup roll sets (5) by displacing away the transversely displaceable carriages (9, 10, 11) to dismount a respective worn-out backup roll set (5) and mount a serviced backup roll set with a crane.

12. A method according to claim 11, wherein the gap-forming step includes closing the gap in front of each rolling mill stand (2, 3, 4) by pivoting the intermediate plates (7*a*), and displacing the respective transversely displaceable carriages (9, 10, 11) to the exchange distances (2*a*, 3*a*, 4*a*).

13. A method according to claim 6, comprising a step of displacing empty transversely displaceable carriages (9, 10, 11), with the intermediate plates (7*a*) being pivoted out, in a parking position at one of the opposite ends of the rolling mill train (1).

* * * * *